US006003429A

United States Patent [19]

Nakabayashi et al.

[11] Patent Number: 6,003,429

[45] Date of Patent: Dec. 21, 1999

[54] HIGH SPEED AND HIGH-LOAD CYLINDER DEVICE AND METHOD FOR CONTROLLING THE SAME

[75] Inventors: Hideaki Nakabayashi; Hitoshi Sawamura, both of Ishikawa, Japan

[73] Assignees: Komatsu Ltd.; Komatsu Industries Corporation, both of Tokyo, Japan

[21] Appl. No.: 08/981,744

[22] PCT Filed: Jun. 27, 1996

[86] PCT No.: PCT/JP96/01790

§ 371 Date: Feb. 11, 1998

§ 102(e) Date: Feb. 11, 1998

[87] PCT Pub. No.: WO97/02132

PCT Pub. Date: Jan. 23, 1997

[30] Foreign Application Priority Data

Jul. 6, 1995 [JP] Japan ..... 7-170740

[51] Int. Cl.[6] ..... F15B 11/00

[52] U.S. Cl. ..... 91/509; 91/519; 60/560

[58] Field of Search ..... 91/421, 435, 458, 91/509, 519; 60/560; 92/152

[56] References Cited

U.S. PATENT DOCUMENTS

| | | | |
|---|---|---|---|
| 3,877,346 | 4/1975 | Koopmann et al. | 91/509 |
| 4,630,442 | 12/1986 | Massaro et al. | 91/519 X |
| 4,805,515 | 2/1989 | Kast | 91/509 X |
| 5,865,088 | 2/1999 | Nakabayashi et al. | 91/519 X |

FOREIGN PATENT DOCUMENTS

| | | |
|---|---|---|
| 55-154700 | 11/1980 | Japan . |
| 57-181499 | 11/1982 | Japan . |
| 6-39285 | 5/1994 | Japan . |
| 6-155089 | 6/1994 | Japan . |

*Primary Examiner*—Hoang Nguyen

*Attorney, Agent, or Firm*—Frishauf, Holtz, Goodman, Langer & Chick, P.C.

[57] ABSTRACT

A high speed and high load operable hydraulic drive cylinder system comprises a principal cylinder (3) with a piston (3*a*)) defining an upper and a lower chamber (3*c*, 3*d*) and a piston rod (3*b*), and a subsidiary cylinder (2) smaller in pressure receiving area than the principal cylinder and a piston (2*a*) defining an upper and a lower chamber (2*c*, 2*d*) and a piston rod (2*b*) smaller in diameter than the piston rod (3*b*). With the cylinders (2, 3) arranged coaxially up/down and the pistons (2*a*, 3*a*) interconnected by the piston rod (2*b*), the system has a fluid feed control so associated with the cylinders (2, 3) as acting to supply pressure fluid into the principal chambers (3*c*, 3*d*) to permit the pistons (2*a*, 3*a*) jointly to descend rapidly with a difference in pressure receiving area between them (3*c*, 3*d*), to supply the fluid into the upper principal chamber (3*c*) to cause the pistons (2*a*, 3*a*) to descend while exerting a pressure, to terminate a supply of the fluid into the principal chambers and the lower subsidiary chamber (2*d*) to maintain the pistons in a position with a pressure held exerted, to supply the fluid into the lower subsidiary chamber and the lower principal chamber to allow the pistons to ascend slowly, and to supply the fluid into the lower subsidiary chamber to permit the pistons to ascend rapidly. Also disclosed is a method of controlling the system.

14 Claims, 10 Drawing Sheets

HIGH SPEED AND HIGH-LOAD CYLINDER DEVICE AND METHOD FOR CONTROLLING THE SAME

TECHNICAL FIELD

The present invention relates to a high speed and high load operable hydraulic cylinder apparatus or system for use as a drive source in a machine tool such as a press, and a method of controlling such a cylinder system or apparatus.

BACKGROUND ART

There have hitherto been known certain hydraulic cylinder devices of the type described as disclosed, for example, in Japanese Unexamined Utility Model Publication No. Hei 6-39285 and Japanese Unexamined Patent Publication No. Hei 6-155089, in the prior art.

There is disclosed in the former publication above a hydraulic cylinder device or apparatus which, as shown in FIG. 1 of the drawings attached hereto, makes use of a high speed cylinder a that has a smaller pressure receiving area and a pressurizing cylinder b that has a larger pressure receiving area, the two cylinders being arranged coaxially and vertically up and down. The two cylinders a and b have their respective pistons c and d interconnected by a piston rod e and are assembled providing a so-called double rod cylinder configuration in which the upper end portion of the piston rod e is allowed to protrude upwards of the high speed cylinder a.

In the apparatus so constructed, it may be noted that via pipes and valves arranged externally of the two cylinder assembly, a pressure fluid is supplied to the high speed cylinder a to cause the pistons c and d to act rapidly and thereafter is supplied to the pressurizing cylinder b to develop an increased pressing force, thereby meeting with a requirement for a greater or higher load.

It may also be noted that the latter publication above discloses a hydraulic cylinder assembly which, in addition to having a basic construction that is essentially the same as the assembly described, as shown in FIG. 2 of the drawings attached hereto, has an interconnecting rod e that is provided, where the rod joins with the piston d in the pressurizing cylinder b, with a sequence valve f that can be opened and closed by a pilot pressure and used to switch the operation from a high speed into a high pressure mode. With the cylinder assembly so constructed, the apparatus is rendered capable of meeting with the requirements for a high speed (rapid) and a high load (heavy) operation without requiring the above mentioned pipes and valves as arranged externally of the cylinder assembly.

Despite these advantages, however, the prior devices have been found to be much unsatisfactory and inconvenient. Thus, the first mentioned known cylinder apparatus has been found defective in providing a satisfactory "detachment" force and therefore inconvenient, for example, when used as a drive source in a press with a pressing (upper) die and a receiving (lower) die where the latter die may have been caused to "bite" the former die in a pressing operation, because it may be rendered unable to detach the die (upper) that was bit from the die (lower) that bit.

It has also been noted that the second mentioned known cylinder apparatus in which a sequence valve f is provided internally where the piston rod e joins with the piston d in the pressurizing cylinder b is found defective and inconvenient because of its poor outfitting capability.

It should further be noted that neither of these assemblies in which the double rod cylinder configuration is adopted for the upper cylinder as well requiring the entire assembly to be lengthened, would be satisfactory or convenient if adapted, for example, in a press because the press would then have to be sized to be greater in height and larger.

Yet, it should be noted that both the arrangements are not economical or convenient because of the requirement that a single rod e serve commonly as both the piston rod for the high speed cylinder a and the piston rod for the pressurizing cylinder b, that is, be hence of a single given for both the cylinders but unnecessarily enlarged diameter for the high speed cylinder.

With the view to eliminating such inconveniences and deficiencies as encountered in the prior art, it is an object of the present invention to provide a high speed and high load operable hydraulic drive cylinder system which makes it easier to detach a die "that has been bit" from a die "that has bit" as mentioned above, allows a press or the like machine tool for use therewith to be considerably smaller sized and is rendered economical. It is another object of the present invention is to provide a method of controlledly operating a system as described.

SUMMARY OF THE INVENTION

In order to achieve the above mentioned object, there is provided in accordance with the present invention in a first form of embodiments thereof a high speed and high load operable drive cylinder system which comprises:

a principal hydraulic cylinder receiving a first piston for defining an upper chamber and a lower chamber therein and having a first piston rod extending from the said first piston, a subsidiary hydraulic cylinder being smaller in pressure receiving area than the said principal cylinder, the said subsidiary cylinder receiving a second piston for defining an upper chamber and a lower chamber therein and having a second piston rod extending from the said second piston and being smaller in diameter than the said first piston rod, the said subsidiary cylinder and the said principal cylinder being arranged coaxially and disposed vertically up and down, respectively, the said first piston and the said second piston being interconnected by the said second piston rod; and a fluid delivery means so constructed and associated with the said principal and subsidiary cylinders as acting in a first mode of operation to supply pressure fluid selectively into both of the upper and lower chambers of the said principal cylinder so as to permit the said interconnected pistons jointly to descend rapidly with a difference in pressure receiving area between the said upper and lower chambers of the principal cylinder, the said fluid delivery means also acting in a second mode of operation to supply pressure fluid selectively into only the upper chamber of the said principal cylinder so as to cause the said interconnected pistons jointly to descend while exerting a pressure downwards, acting in a third mode of operation to terminate a supply of pressure fluid into the upper and lower chambers of the said principal cylinder and the lower chamber of the said subsidiary cylinder so as to maintain the said interconnected pistons substantially in a position with a pressure downwards held exerted and acting in a fourth mode of operation to supply pressure fluid selectively into both of the lower chamber of the said subsidiary cylinder and the lower chamber of the said principal cylinder so as to permit the said interconnected pistons jointly to ascend slowly, the said fluid delivery means further acting in a fifth mode of operation to supply pressure fluid selectively into only the lower chamber of the said subsidiary cylinder so as to permit the said interconnected pistons jointly to ascend rapidly.

The present invention provides in another form of embodiments thereof a high speed and high load operable hydraulic drive cylinder system which comprises:

a principal hydraulic cylinder receiving a first piston for defining an upper chamber and a lower chamber therein and having a first piston rod extending from the said first piston, a subsidiary hydraulic cylinder being smaller in pressure receiving area than the said principal cylinder, the said subsidiary cylinder receiving a second piston for defining an upper chamber and a lower chamber therein and having a second piston rod extending from the said second piston and being smaller in diameter than the said first piston rod, the said subsidiary cylinder and the said principal cylinder being arranged coaxially and disposed vertically up and down, respectively, the said first piston and the said second piston being interconnected by the said second piston rod; and a fluid delivery means so constructed and associated with the said principal and subsidiary cylinders as acting in a first mode of operation to supply pressure fluid selectively into both of the upper and lower chambers of the said principal cylinder so as to permit the said interconnected pistons jointly to descend rapidly with a difference in pressure receiving area between the said upper and lower chambers of the principal cylinder, the said fluid delivery means also acting in a second mode of operation to supply pressure fluid selectively into both of the upper chamber of the said subsidiary cylinder and the upper chamber of the said principal cylinder so as to cause the said interconnected pistons jointly to descend while exerting a pressure downwards, acting in a third mode of operation to terminate a supply of pressure fluid into the upper and lower chambers of the said principal cylinder and the upper and lower chamber of the said subsidiary cylinder so as to maintain the said interconnected pistons substantially in a position with a pressure downwards held exerted and acting in a fourth mode of operation to supply pressure fluid selectively into both the lower chamber of the said subsidiary cylinder and the lower chamber of the said principal cylinder so as to permit the said interconnected pistons jointly to ascend slowly, the said fluid delivery means further acting in a fifth mode of operation to supply pressure fluid selectively into only the lower chamber of the said subsidiary cylinder so as to permit the said interconnected pistons jointly to ascend rapidly.

According to each of the system constructions set forth above, it will be seen and should be understood that not only can a high speed and a high load operation be readily achieved but also a greater raising force can be obtained with the principal and subsidiary cylinders while the pistons are being raised and thereby ascending. Thus, for example, where the system is applied to a press, it follows that the pressing die that may have be bit by the receiving die in a pressing operation can thereby be readily detached from the latter die.

It can also be seen and should be understood that each of the subsidiary cylinders of the systems set forth allows a single rod cylinder/piston configuration to be adopted, thus permitting the entire cylinder assembly to be considerably reduced in length and height.

There is also provided in accordance with the present invention in another aspect thereof a method of controlling each of the high speed and high load operable hydraulic drive cylinder systems described, which method may in a first form of embodiments thereof comprise the steps of:

causing the said interconnected pistons jointly to descend rapidly followed by descending while exerting a pressure downwards; and thereafter permitting the said interconnected pistons to ascend rapidly.

It will be seen and should be understood that the method with such a first sequence of steps provides an extremely suitable pattern of modes operations for a blanking press process as well as for a bending press process.

The method of controlling each of the high speed and high load operable hydraulic drive cylinder systems described, in accordance with the present invention, may alternatively comprise, in a second form of embodiments thereof, the steps of:

causing the said interconnected pistons jointly to descend rapidly followed by descending while exerting a pressure downwards;

thereafter maintaining the said interconnected pistons substantially in a position with a pressure downwards held exerted, and thereafter permitting the said interconnected pistons to ascend slowly followed by ascending rapidly.

It will be seen and should be understood that the method with such a second sequence of steps provides an extremely suitable alternative pattern of modes operations for a blanking press process and a bending press process and such a pattern of modes of operation for a coining press process.

The method of controlling each of the high speed and high load operable hydraulic drive cylinder systems described, in accordance with the present invention, may alternatively comprise, in a third form of embodiments thereof, the steps of:

causing the said interconnected pistons jointly to descend while exerting a pressure downwards;

thereafter maintaining the said interconnected pistons substantially in a position with a pressure downwards held exerted; and thereafter permitting the said interconnected pistons jointly to ascend slowly.

It will be seen and should be understood that the method with such a third sequence of steps allows the slide to be moved vertically with a small change in position and hence provides an extremely suitable pattern of modes of operations with an enhanced efficiency, especially for a coining press process. Since the change in position is small, a given working process can be carried out also with an improved operator's safety.

The method of controlling each of the high speed and high load operable hydraulic drive cylinder systems described, in accordance with the present invention, may alternatively comprise, in a fourth form of embodiments thereof, the steps of:

causing the said interconnected pistons jointly to descend rapidly followed by descending while exerting a pressure downwards;

thereafter maintaining the said interconnected pistons substantially in a position with a pressure downwards held exerted;

thereafter causing the said interconnected pistons jointly to descend while exerting a pressure downwards;

thereafter maintaining the said interconnected pistons substantially in a position with a pressure downwards held exerted; and thereafter permitting the said interconnected pistons jointly ascend slowly followed by ascending rapidly.

It will be seen and should be understood that the method with such a fourth sequence of steps provides an extremely suitable pattern of modes of operations for performing a swaging process in multiple steps, or a swaging or bending process followed by a blanking press process.

BRIEF DESCRIPTION OF THE DRAWINGS

The present invention will better be understood from the following detailed description and the drawings attached hereto showing certain illustrative embodiments of the present invention. In this connection, it should be noted that such embodiments as illustrated in the accompanying drawings are intended in no way to limit the present invention but to facilitate an explanation and understanding thereof.

In the accompanying drawings.

BEST MODES FOR CARRYING OUT THE INVENTION

Hereinafter, suitable embodiments of the present invention with respect to a high speed and high load operable cylinder system and a method of controlling the same will be set forth in detail with reference to the accompanying drawings hereof.

An explanation will now be given with respect to a certain embodiment of high speed and high load operable hydraulic drive cylinder system according to the present invention with reference to FIGS. 3 and 4.

In these Figures, a hydraulic cylinder assembly 1 comprises a principal hydraulic cylinder 3 having a larger pressure receiving area with an inner diameter D1 and a subsidiary hydraulic cylinder 2 having a smaller pressure receiving area with an inner diameter D2.

The subsidiary and principal cylinders 2 and 3 are arranged coaxially and are disposed vertically up and down, respectively, and they have pistons 2*a* and 3*a* received respectively therein, defining an upper and a lower chamber 2*c* and 2*d* and an upper and a lower chamber 3*c* and 3*d*, respectively.

The piston 2*a* received in the subsidiary cylinder 2 has a lower surface from which a piston rod 2*b* with an outer diameter d2 projects downwards so that its lower is connected to the upper surface of the piston 3*a* received in the principal cylinder 3. The lower surface of the piston 3*a* has a piston rod 3*b* projecting therefrom, having a outer diameter d1 that is greater than the outer diameter d2 of the piston rod 2*b*. The piston rod 3*b* towards its lower end penetrates an end plate 3*e* of the principal cylinder 3 to project out of the latter downwards.

Figure 1:
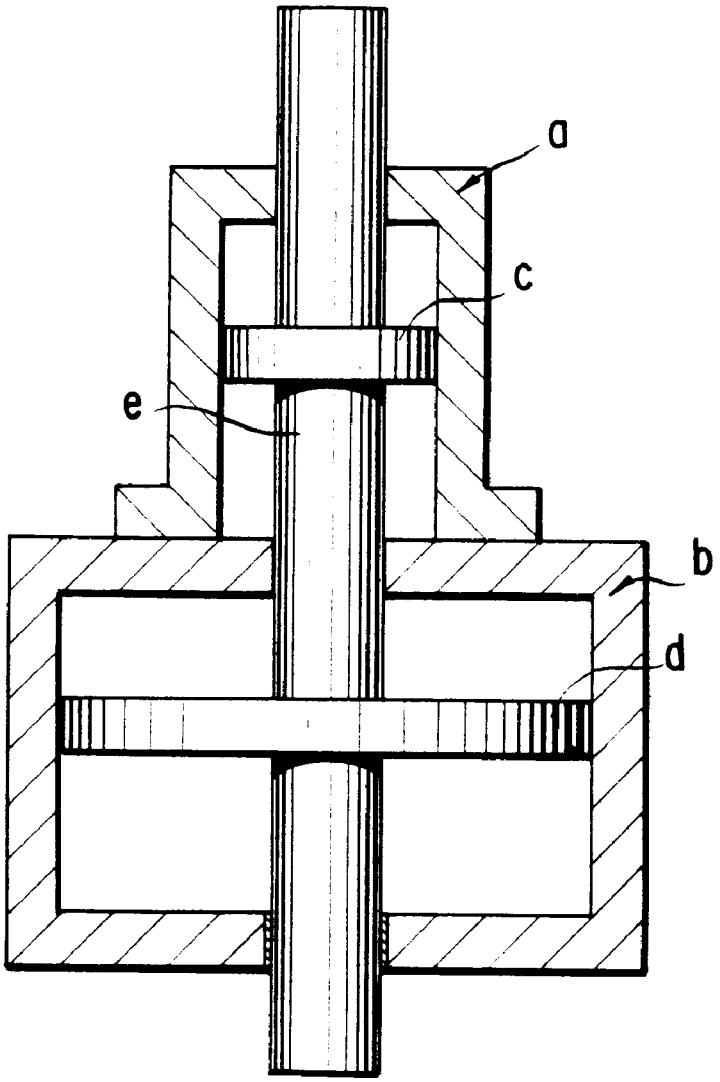
FIG. 1 (PRIOR ART)
FIG. 1 is an explanatory view that illustrates one example of high speed and high load operable hydraulic drive cylinder apparatus in the prior art.
Figure 2:
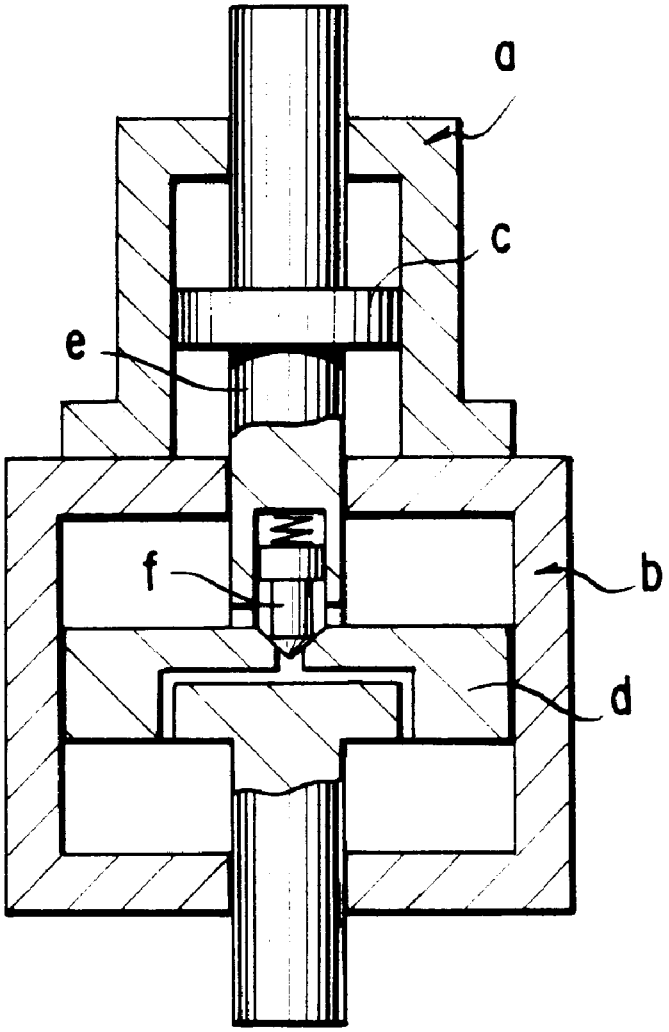
FIG. 2 (PRIOR ART)
FIG. 2 is an explanatory view that depicts another example of high speed and high load operable hydraulic drive cylinder apparatus in the prior art.
Figure 3:
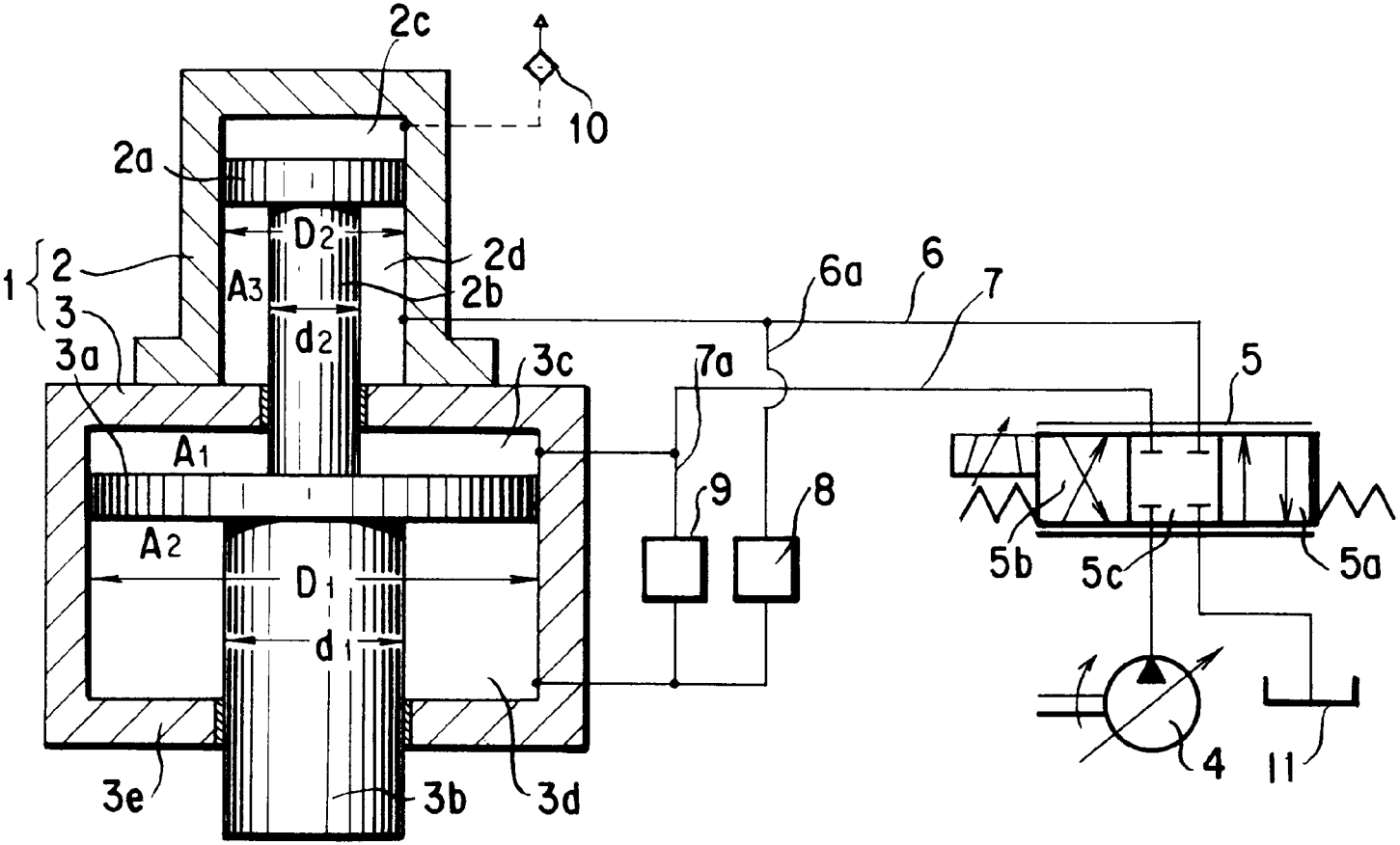
FIG. 3 is a constructive view that illustrates a certain embodiment of high speed and high load operable hydraulic drive cylinder system in accordance with the present invention.
Figure 4:
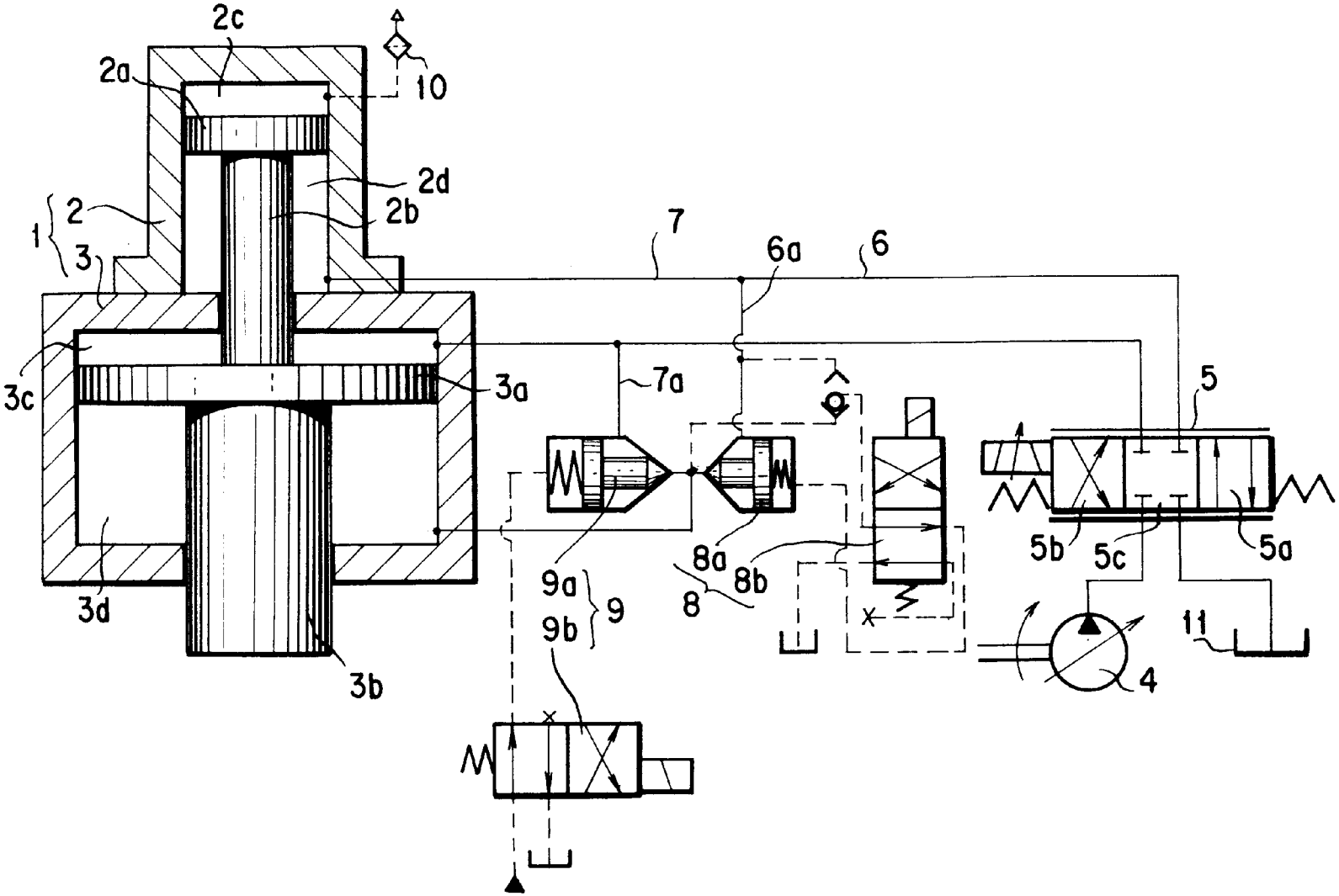
FIG. 4 is a detailed view that illustrates a portion of the switching valve in the above mentioned embodiment of the present invention.

On the other hand, as shown in both FIGS. 3 and 4 a hydraulic source 4 comprises a variable capacity pump and is seen to supply its discharge pressure fluid into the lower chamber 2*d* of the subsidiary cylinder 2 and the upper chamber 3*c* of the principal cylinder 3 via a servo valve 5 commonly and a first and a second pipe conduit 6 and 7, respectively.

It will also be seen that the first and second pipe conduits 6 and 7 are branched midway to lead into pipe conduits 6*a* and 7*a* which are connected commonly to the lower chamber 3*d* of the principal cylinder 3 via a pressurization switching valve 8 and a differential circuit switching valve 9, respectively.

It should be noted at this point that the valves 8 and 9 as shown in FIG. 4 may comprises logic valves 8*a* and 9*a* and pilot switching valves 8*b* and 9*b*, respectively, switching the logic valves 8*a* and 9*a* to turn ON and OFF, respectively.

It can also be seen that the upper chamber 2*c* of the subsidiary cylinder 2 may be allowed to communicate with the atmosphere via a breather 10.

An explanation will next be given with respect to an operation of the embodiment of the invention described. It should be noted here that in the description which follows, the terms "ON" and "OFF" for a valve are intended to mean that the valve is open and closed, respectively.

It should further be noted that in a case where the high speed and high load operable hydraulic cylinder system here is used in a press as its drive source, the cylinder assembly 1 is assumed to be installed within the press crown( not shown) with its slide (not shown) connected to the lower end of the piston rod 3*b* of the principal cylinder 3.

Now, let it be assumed that the slide is to be lowered rapidly from an upper dead point in order to start a pressing operation. Then, with the logic valve 8*a* in the pressurization switching valve assembly 8 turned OFF and the logic valve 9*a* in the differential circuit switching valve assembly 9 turned ON, the servo valve 5 will be switched from its neutral position 5*c* to its slide lowering position 5*a*.

This will cause pressure fluid discharged from the fluid source 4 to be supplied into the upper and lower chambers 3*c* and 3*d* of the principal cylinder 3 and pressure fluid to flow out of the lower chamber 2*d* of the subsidiary cylinder 2 into a reservoir 11, thus permitting the piston rod 3*b* to descend rapidly with a difference between the pressure receiving area A1 of the upper chamber 3*c* and the pressure receiving area A2 of the lower chamber 3*d* of the principal cylinder 3.

Next, when a state is established in which the slide has been lowered to a predetermined position requiring a pressing force to be applied or a pressure to be exerted downwards, with the servo valve 5 held at its slide lowering position 5*a* the logic valve 8*a* in the pressurization switching valve assembly 8 will be turned ON and the logic valve 9*a* in the differential circuit switching valve assembly 9 will be turned OFF.

This permitting the pressure fluid discharged from the hydraulic source 4 to be fully delivered into the upper chamber 3*c* of the principal cylinder 3, there will develop an increased pressure or pressing force and a state that can meet with the requirement for a greater load.

Then, if a lower dead point has been reached by the slide so that a press forming operation has been completed, with the logic valve 8*a* in the pressurization switching valve assembly 8 held ON and the logic valve 9*a* in the differential circuit switching valve assembly 9 held OFF the servo valve 54 will be switched to its slide raising position 5*b*.

This will allow the pressure fluid discharged from the hydraulic source 4 to be delivered into both the lower chamber 2*d* of the subsidiary cylinder 2 and the lower chamber 3*d* of the principal cylinder 3 and the pressure fluid to flow out of the upper chamber 3*c* of the principal cylinder 3 into the reservoir 11, thus permitting the interconnected pistons 2*b* and 3*b* to commence ascending. Then a situation may have developed in which the pressing upper die is bit by the receiving lower die and is normally difficult to remove from the latter die. Here, however, with an increased raising force generated by both of the pressure fluid supplied into the lower chamber 3*d* of the principal cylinder 3 and the pressure fluid supplied into the lower chamber 2*d* of the subsidiary cylinder 2, the upper pressing die can readily be detached and removed from the lower receiving die if a bite as mentioned has occurred.

When the upper die is removed from the lower die, with the servo valve 5 held at its slide raising position the logic valve 8*a* in the pressurization switching valve assembly 8 will be turned OFF and the logic valve 9*a* in the differential circuit switching valve assembly 9 will be turned ON. This will allow the pressure fluid discharged from the hydraulic source 4 to be fully delivered to the lower chamber 2*d* of the subsidiary cylinder 2 and the at the same time the pressure fluid to flow out of the upper chamber 3*c* of the principal cylinder 3 into the lower chamber 3*d* of the principal cylinder 3 via the differential circuit switching valve assembly 9, thus permitting the slide to ascend quickly up to its upper dead point.

It should be noted at this point that in a case where a die-punching operation is to be performed, a noise or vibrations may be generated for the reason of a breakthrough that would happen when a workpiece is punched. Here, however, with the sum of the pressure receiving area A3 of the lower chamber 2*d* in the subsidiary cylinder 2 and the pressure receiving area A2 of the lower chamber 3*d* in the principal cylinder 3 being equal to the area on which the breakthrough load is received, it will be possible to significantly reduce the peak pressure that would develop when the break-through has occurred. In addition, with the area on which the breakthrough load is received being equal to the sum of the pressure receiving area A3 of the lower chamber 2*d* in the subsidiary chamber 2 and the pressure receiving area A2 of the lower chamber 3*d* in the principal chamber 3, the noise or vibration due to the breakthrough can be significantly reduced.

Also, it has been found that setting the diametrical size of each of the parts allows a change in the entire pressure receiving area of the cylinder assembly 1 as stated below (assuming that D1>d1 is known).

Where D1>D2 and D2=d1>d2, A1−A2=A3

Where D1>D2 and D2>d1>d2, A1−A2<A3

Where D1>D2 and d1>D2>d2, A1−A2>A3

Figure 5:
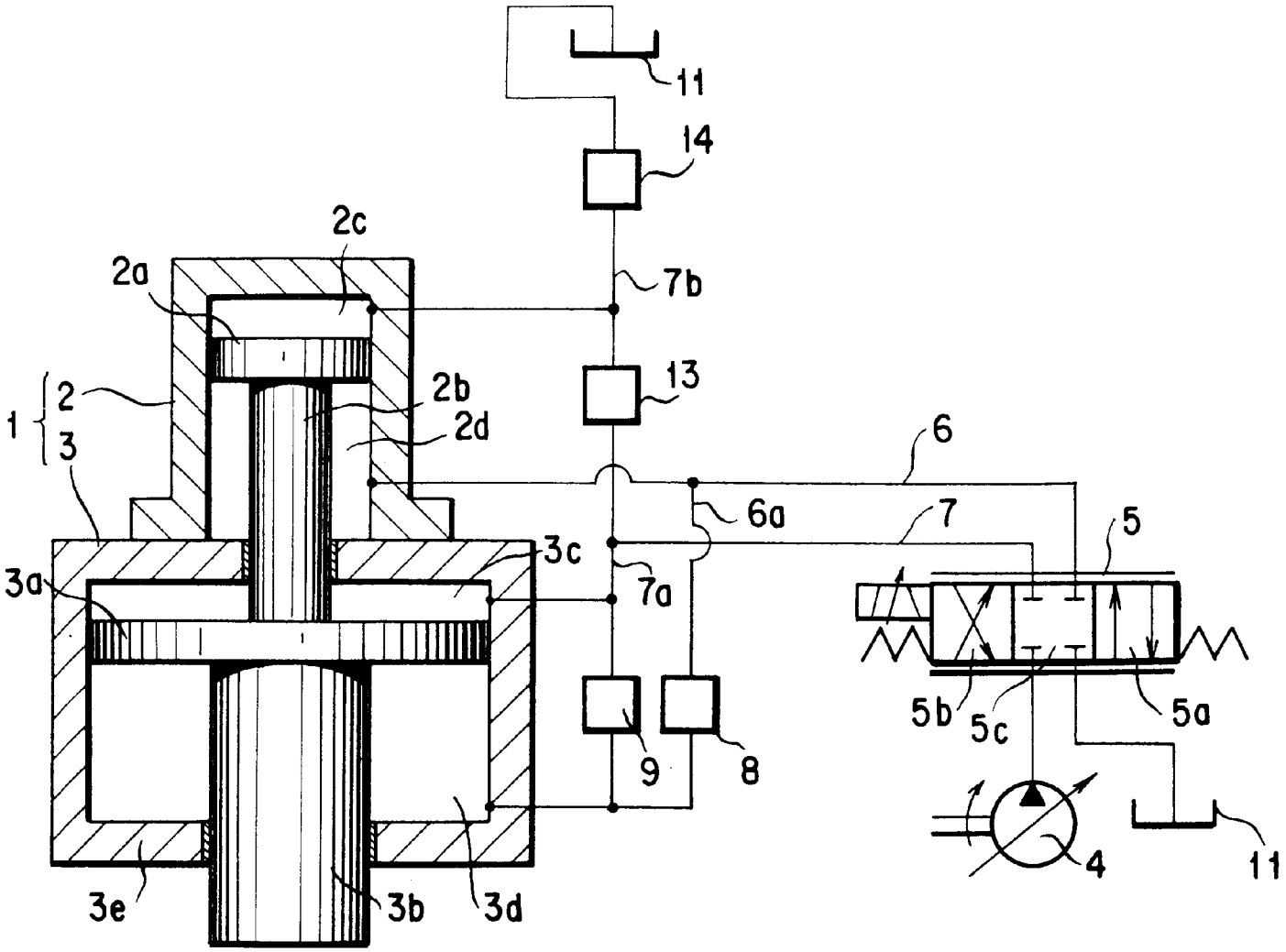
FIG. 5 is a constructive view that depicts anther embodiment of high speed and high load operable hydraulic drive cylinder system in accordance with the present invention.
Figure 6:
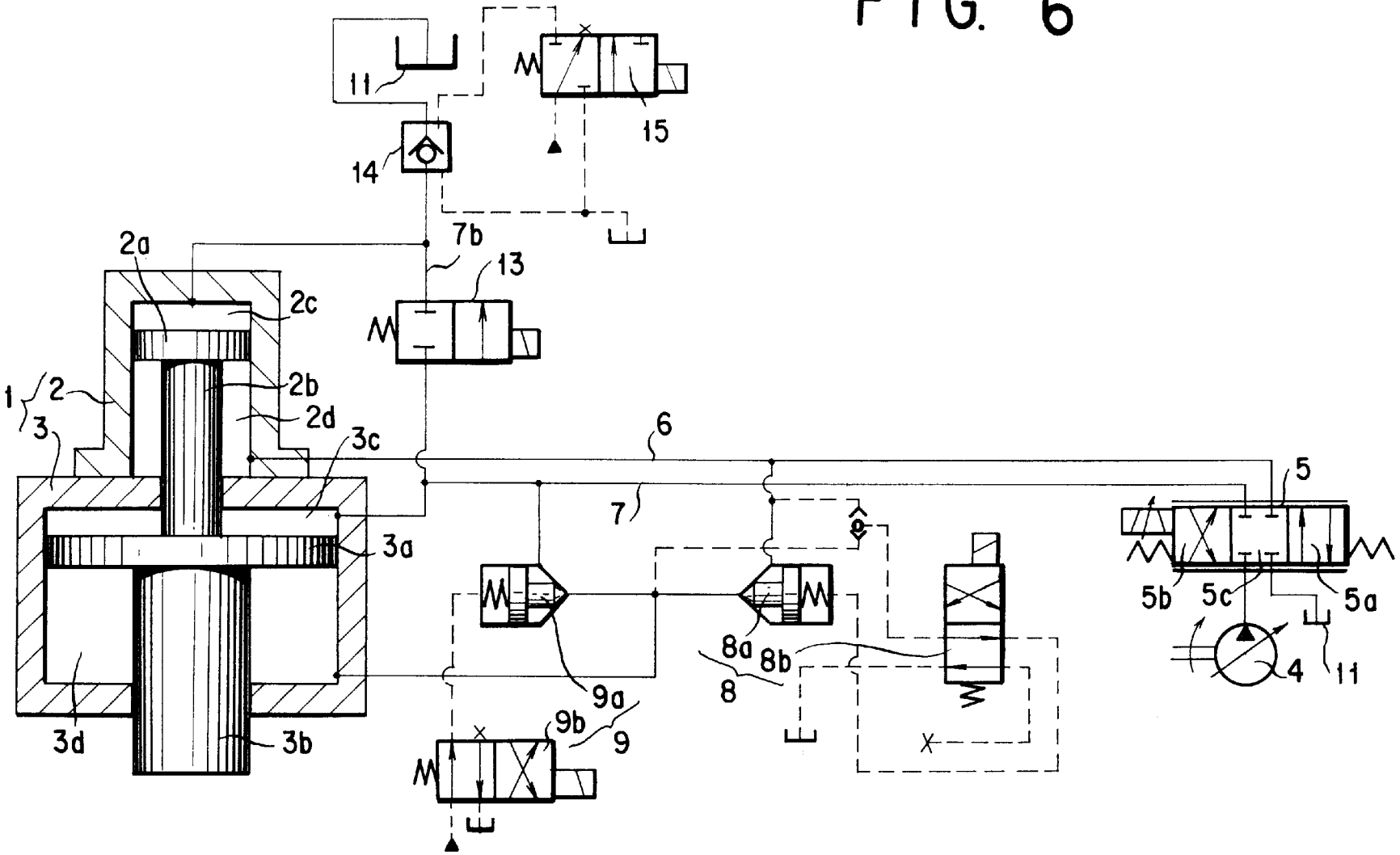
FIG. 6 is a detailed view that illustrates a portion of the switching valve in the second mentioned embodiment of the present invention.

FIGS. 5 and 6 show another embodiment of the high speed and high load operable hydraulic drive cylinder system according to the present invention, which will now be explained.

This embodiment includes a principal hydraulic cylinder 3 and a subsidiary hydraulic cylinder 2 which are structurally the same as in the previous embodiment, but differs from the first embodiment in that a second pressurization switching valve 13 which comprises an electromagnetic valve is provided midway in the second pipe conduit 7 and that the pipe conduit 7*a* which is branched from the second conduit 7 is connected to the reservoir 11 via a prefill valve 14 which is adapted to be turned ON and OFF by an electromagnetic valve 15. A specific hydraulic circuit that may be employed in the second embodiment is shown in FIG. 6.

An explanation will below be given with respect to an operation of the second embodiment so constructed.

Firstly, the slide will have to be lowered from its upper dead point. To this end, both the logic valve 8*a* in the first pressurization switching valve assembly 8 and the second pressurization switching valve 13 will be turned OFF whereas both the logic valve 9*a* in the differential circuit switching valve assembly 9 and the prefill valve 14 will be turned ON. And in that state the servo valve 5 will then be switched from the neutral position 5*c* to the slide lowering position 5*a*.

This will cause pressure fluid discharged from the hydraulic source 4 to be delivered into both the upper and lower chambers 3*c* and 3*d* of the principal cylinder 3 and allow fluid in the reservoir 11 to be sucked into the upper chamber 2*c* of the subsidiary cylinder 2 via the prefill filter 14 and pressure fluid to flow out of the lower chamber 2*d* of the subsidiary cylinder 2 into the reservoir 11, thus permitting the slide to be lowered rapidly with a difference in pressure receiving area between the upper and lower chambers 3*c* and 3*d* of the principal cylinder 3.

Subsequently, with the servo valve 5 held at the lowering position 5*a*, both the logic valve 8*a* in the first pressurization switching valve assembly 8 and the second pressurization switching valve unit 13 will be turned ON whereas both the logic valve 9*a* in the differential circuit switching valve assembly 9 and the prefill valve 14 will be turned OFF. This will cause the pressure fluid to be delivered into both the upper chamber 2*c* of the subsidiary cylinder 2 and the upper chamber 3*c* of the principal cylinder 3 and allow the pressure fluid to flow out of the lower chamber 2*d* of the subsidiary chamber 2 and the lower chamber 3*d* of the principal cylinder 3 into the reservoir 11, thus permitting this embodiment to rise to an increased pressing force or an elevated pressure downwards to meet with the requirement for a greater load.

Thereafter, the logic valve 8*a* in the first pressurization switching valve assembly 8 and the second pressurization switching valve unit 13 will be turned ON whereas the logic valve 9*a* in the differential circuit switching valve assembly 9 and the prefill valve 14 will be turned OFF, in which state the servo valve 5 will be switched to the raising position to 5*b*. This will cause the pressure fluid to be delivered into both the lower chamber 2*d* of the subsidiary cylinder 2 and the lower chamber 3*d* of the principal chamber 3 and the pressure fluid to flow out of the upper chamber 2*c* of the subsidiary cylinder 2 and the upper chamber 3*c* of the principal cylinder 3 into the reservoir 11 so that a large raising force may be created, which will be sufficient to detach and remove the upper die readily from the lower die if a bite may have been brought about between them. Thereafter, turning both the first and second pressurization switching valves 8 and 13 OFF and both the differential circuit switching valve 9 and the prefill valve 14 ON while the slide is being raised will cause the pressure fluid to be delivered into the lower chamber 2*d* of the subsidiary cylinder 2 and allow the pressure fluid to flow out of the upper chamber 2*c* of the subsidiary cylinder 2 into the reservoir 11 and the pressure fluid to flow out of the upper chamber 3*c* of the principal cylinder 3 and to flow via the differential circuit switching valve 9 into the lower chamber 3*d* of the principal chamber 3, thus permitting the slide to ascend up to its upper dead point.

While the foregoing description has been given for a generalized pattern of slide movements in a hydraulic press, it should be noted that the controlled operation of the servo valve 5, the first and second pressurization switching valves 8 and 13, the differential circuit switching valve 9 and the prefill valve 14 in varied manners will give rise, for a variety of pressing operations, to a corresponding variety of curves graphically representing changes in slide position with respect to time.

Figure 7:
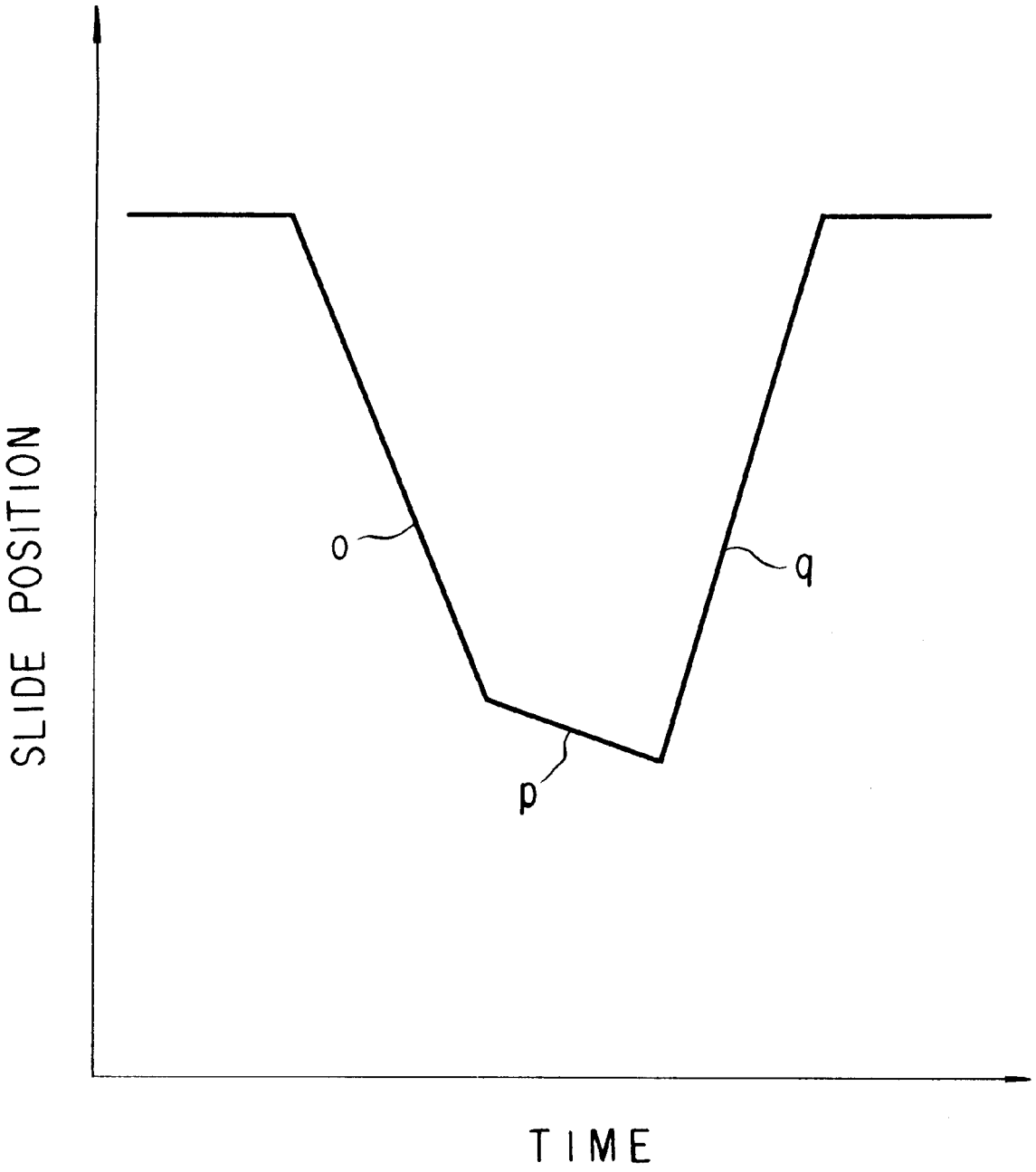
FIG. 7 is a diagram that carries a graph which represents a relationship of the position of a slide with respect to time that can be seen in performing a first example of method of controlling a high speed and high load hydraulic drive cylinder system in accordance with the present invention.

Referring to the hydraulic circuit shown in FIG. 3 , let it be first assumed that a change in slide position curve as appear in FIG. 7 is to be obtained from the state in which the slide is stopped at its upper dead point. Then, the servo valve 5 will be switched from the neutral position 5*c* to the slide lowering position 5*a*, the pressurization switching valve 8 will be turned OFF, and the differential circuit switching valve 9 will be turned ON.

This will cause pressure fluid discharged from the hydraulic source 4 to be supplied into both the upper and lower chambers 3*c* and 3*d* of the principal cylinder 3 and allow pressure fluid to flow out of the lower chamber 2*d* of the subsidiary cylinder 2 into the reservoir 11, thus permitting the slide connected to the piston 3*b* to descend rapidly, as shown by the line segment o of the curve in FIG. 7, with a difference between the pressure receiving area A1 of the upper principal chamber 3*c* and the pressure receiving area A2 of the lower principal chamber A2.

Then, where the slide is lowered to a predetermined position requiring a pressing force or a pressure downwards, the pressurization switching valve 8 will be turned ON and the differential circuit switching valve 9 will be turned OFF while maintaining the servo valve 5 at the slide lowering position.

This will cause the pressure fluid discharged from the hydraulic source 4 to be delivered solely into the upper chamber 3*c* of the principal cylinder 3 and allow pressure fluid to flow out of the lower chamber 2*d* of the subsidiary cylinder 2 and the lower chamber 3*d* of the principal cylinder 3 into the reservoir 11, thus permitting the slide to descend while slowing down, as shown by the line segment p in the curve shown in FIG. 7 and then a large pressing force or pressure downwards to be created.

Subsequently, switching the servo valve 5 to the slide raising position 5*b* and turning the pressurization switching valve 8 OFF and the differential circuit switching valve 9 ON will cause the pressure fluid discharged from the hydraulic source to be entirely delivered into only the lower chamber 2*d* of the subsidiary cylinder 2 and at the same time the pressure fluid to flow out of the upper chamber 3*c* of the principal cylinder 3 and then to flow via the differential circuit switching valve 9 into the lower chamber 3*d* of the principal cylinder 3, thus permitting the slide ascend rapidly, as shown by the line segment q of the curve shown in FIG. 7, up to its upper dead point.

It has been found that a change in slide position curve as obtained by the method of controlled operation set forth in the preceding paragraphs and shown in FIG. 7 is highly suitable for use particularly in blanking, bending or coining a workpiece, and the method, because of the ability to form the workpiece in a state devoid of any load of a surge, in contrast to the use of a press in which a slide is driven by a mechanical slide driving mechanism (hereinafter after the mechanical press), allows a die or mold to be prepared with less wear or damage and with a prolonged life of its utility assured.

Also, in obtaining a change in slide position curve as shown in FIG. 7 with another modified hydraulic circuit shown in FIG. 5, it is recommended to set the servo valve (SV) 5, the first and second pressurization switching valves (1 PSV) 8 and (2 PVS) 13, the differential switching valve (DSV) 9 and the prefill valve (PFV) 14 in a manner as listed in Table 1 below.

TABLE 1

| SV 5 | Stop Position 5c | | Rapid Descend Position 5a | Pressure Descend Position 5a | Rapid Ascend Position 5b | Stop Position 5c | |
|---|---|---|---|---|---|---|---|
| 1 PSV 8 | ON | OFF | OFF | ON | OFF | ON | OFF |
| 2 PSV 13 | ON | OFF | OFF | ON | OFF | ON | OFF |
| DSV 9 | OFF | ON | ON | OFF | ON | OFF | ON |
| PFV 14 | OFF | ON | ON | OFF | ON | OFF | ON |

Figure 8:
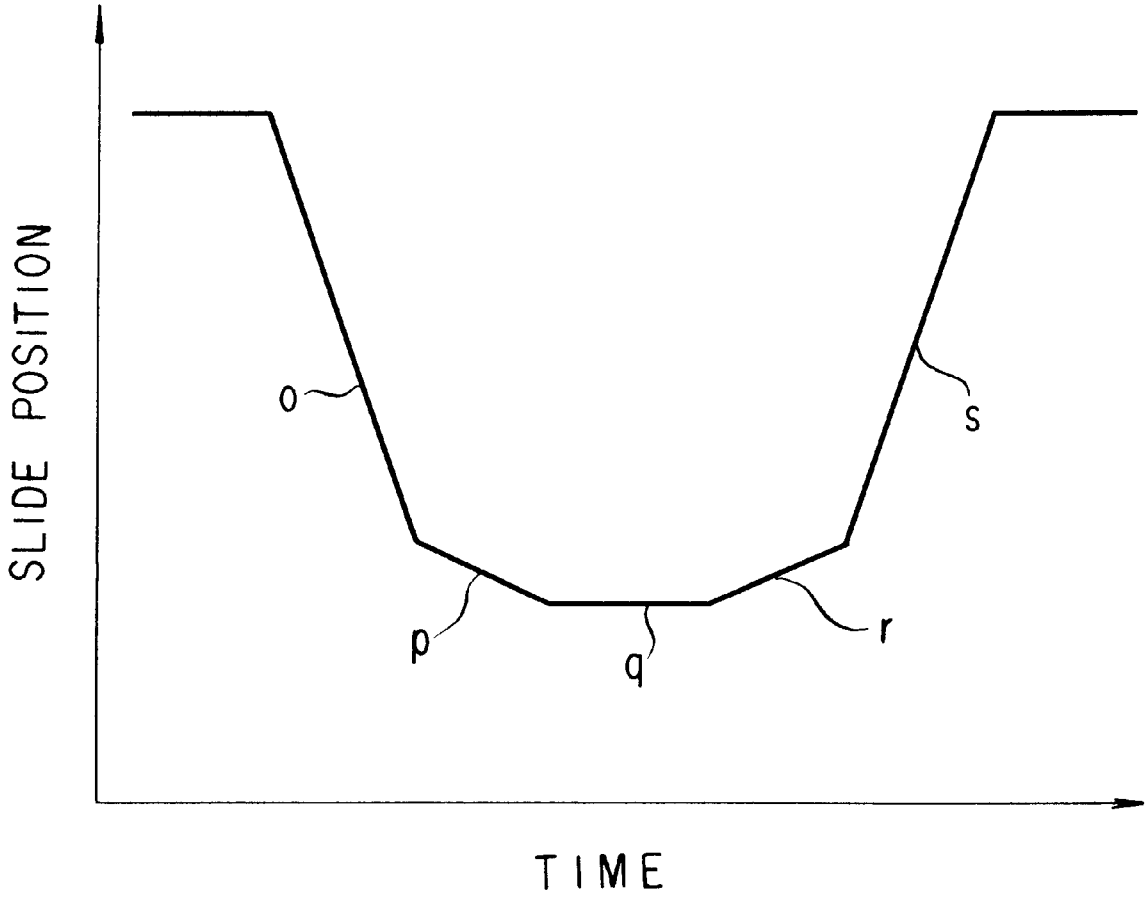
FIG. 8 is a diagram that carries a graph which represents a relationship of the position of a slide with respect to time that can be seen in performing a second example of method of controlledly operating a high speed and high load hydraulic drive cylinder system in accordance with the present invention.

On the other hand, in a pressing process such as blanking, bending or coining, it is customary during a working operation to cause the slide to descend while exerting a pressure downwards, to maintain the workpiece in position with a pressure held exerted, or to cause the slide to ascend slowly by a slight distance to remove the pressing force. A change in slide position curve then applicable may be as shown in FIG. 8.

In obtaining that change in slide position curve with a hydraulic circuit shown in FIG. 3 , the servo valve 5, the pressurization switching valve 8 and the differential switching valve 9 can be controlled as set forth below.

Thus, starting with the state in which the slide is stopped at its upper dead point, the servo valve 5 will be switched from the neutral position to the slide lowering position 5*a*, the pressurization switching valve 8 will be turned OFF, and the differential circuit switching valve 9 will be turned ON.

This will cause pressure fluid discharged from the hydraulic source 4 to be delivered into both the upper and lower chambers 3*c* and 3*d* of the principal cylinder 3 and allow pressure fluid to flow out of the lower chamber 2*d* of the subsidiary cylinder 3 into the reservoir 11, thus permitting the slide connected to the piston 3*b* to descend rapidly, as indicated by the line segment o of the curve shown in FIG.

8, with a difference between the pressure receiving area A1 of th upper chamber 3*c* and the pressure receiving area A2 of the lower chamber 3*d* of the principal cylinder 3. When the slide is lowered to a predetermined position requiring a pressing force to be exerted, the pressurization switching valve 8 will be turned ON and the differential circuit switching valve 9 will be turned OFF while maintaining the servo valve 5 at the slide lowering position 5*a*.

This will cause the pressure fluid discharged from the hydraulic source 4 to be solely delivered into the upper chamber 3*c* of the principal cylinder 3 and allow the pressure fluid to flow out of the lower chamber 3*d* of the principal cylinder 3 into the reservoir 11, thereby permitting the slide to descend further while being decelerated down to its lower dead point as indicated by the line segment p of the curve in FIG. 8 and then a large pressing force to be created.

Thence, should there be a pressure exerted downward, the servo valve 5 will once be returned to the neutral position while maintaining the pressurization switching valve 8 ON and the differential circuit switching valve OFF. This will cause the slide to be stopped at that position as indicated by the line segment q of the curve in FIG. 8, thereby permitting the workpiece to be held in position with a pressure held exerted.

Thereafter, switching the servo valve 5 to the slide raising position 5*b* while maintaining the pressurization switching valve 8 ON and the differential circuit switching valve 9 OFF will cause the pressure fluid discharged from the hydraulic source to be delivered into the lower chamber 2*d* of the subsidiary cylinder 2 and the lower chamber 3*d* of the principal cylinder 3 at the same time, thereby permitting the slide to commence ascending slowly as indicated by the line segment r of the curve in FIG. 8 and then the pressing force exerted against the workpiece to be gradually to be released, a so-called pressure removal to be effected.

Subsequently, turning the pressurization switching valve 8 OFF and the differential circuit switching valve 9 ON while maintaining the servo valve 5 at the slide raising position 5*b* will cause the pressure fluid discharged from the hydraulic source 4 to be delivered entirely into only the lower chamber 2*d* of the subsidiary cylinder 2 and at the same time the fluid to flow out of the upper chamber 3*d* of the principal cylinder 3 and then to flow via the differential circuit switching valve 9 into the lower chamber 3*d* of the principal cylinder 3, thereby permitting the slide to ascend rapidly, as indicated by the line segment s of the curve in FIG. 8, up to its upper dead point.

It has been found that performing the method of controlled operations set forth in the preceding paragraphs enables several process steps including the steps of maintaining a workpiece in position with a pressure held exerted and permitting a pressing force to be released to be carried out during a given forming process and, having the ability to form the workpiece on a state devoid of any load of a surge, allows a die or mold to be prepared with less wear or damage from the workpiece in reduced number of process step and with a prolonged life of its utility assured, as compared with the use of a mechanical press.

Also, in obtaining a change in slide position curve as shown in FIG. 8 with the modified hydraulic circuit shown in FIG. 5, it is recommended to set the servo valve (SV) 5, the first and second pressurization switching valves (1 PSV) 8 and (2 PVS) 13, the differential switching valve DSV) 9 and the prefill valve (PFV) 14 in a manner as listed Table 2 below.

TABLE 2

| SV 5 | Stop Position 5c | | Rapid Descend Position 5a | Pressure Descend Position 5a | Pressure Retained Position 5c | Slow Ascend Position 5b | Rapid Ascend Position 5b | Stop Position 5c |
|---|---|---|---|---|---|---|---|---|
| 1 PSV 8 | ON | OFF | OFF | ON | ON | ON | OFF | OFF |
| 2 PSV 13 | ON | OFF | OFF | ON | ON | ON | OFF | OFF |
| DSV 9 | OFF | ON | ON | OFF | OFF | OFF | ON | ON |
| PFV 14 | OFF | ON | ON | OFF | OFF | OFF | ON | ON |

Figure 9:
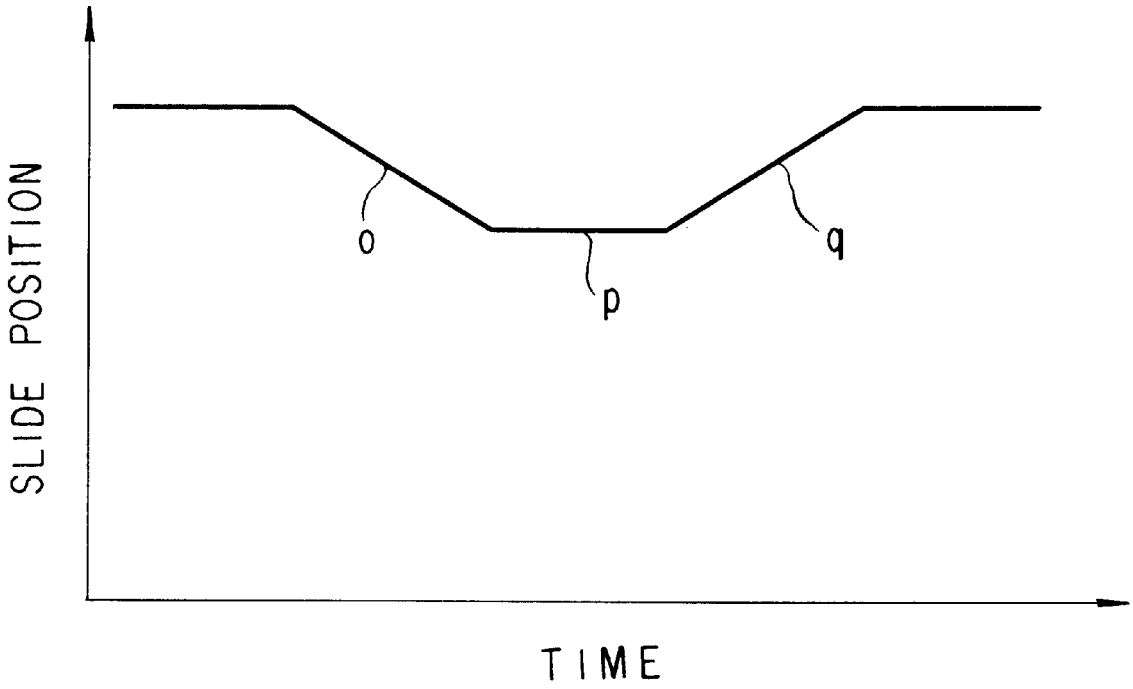
FIG. 9 is a diagram that carries a graph which represents a relationship of the position of a slide with respect to time that can be seen in performing a third example of method of controlling a high speed and high load hydraulic drive cylinder system in accordance with the present invention.

On the other hand, in a pressing process such as blanking, bending or coining, where working is possible if a change in slide position is small as shown in FIG. 9, the servo valve 5, the pressurization switching valve 8 and the differential switching valve 9 can be controlled as set forth below in obtaining that change in slide position curve.

First, starting with the state in which the slide is stopped at its upper dead point, the servo valve 5 will be switched from the neutral position 5*c* to the slide lowering position 5*a*, the pressurization switching valve 8 will be turned ON, and the differential circuit switching valve 9 will be turned OFF.

This will cause pressure fluid discharged from the hydraulic source 4 to be delivered into the upper chamber 3*c* of the principal cylinder 3 and allow pressure fluid to flow out of the lower chamber 3*d* of the principal cylinder 3 and the lower chamber 2*d* of the subsidiary cylinder 3 into the reservoir 11, thus permitting the slide to descend slowly as indicated by the line segment o of the curve shown in FIG. 9.

When the slide has been lowered down to a predetermined position, if the workpiece is to be maintained in position with a pressure held exerted, the servo valve 5 will be switched to the neutral position 5*c* with the pressurization switching valve 8 held ON and the differential circuit switching valve 9 held OFF.

This will cause the slide to be stopped at that position as indicated by the line segment p of the curve in FIG. 9, thereby permitting the workpiece to be held in position with a pressure held exerted.

Subsequently, should the slide be to ascend, the servo valve 5 will be switched to the slide raising position 5*b* with the pressurization switching valve 8 held ON and the differential circuit switching valve 9 held OFF.

This will cause the pressure fluid discharged from the hydraulic source 4 to be supplied into the lower chamber 2*d* of the subsidiary cylinder 2 and the lower chamber 3*d* of the principal cylinder 3 and allow the fluid to flow out of the upper chamber 3*c* of the principal cylinder 3 into the reservoir 11, thereby permitting the slide to ascend slowly as indicated by the line segment q of the curve in FIG. 9.

It has been found that performing the method of controlled operation set forth in the preceding paragraphs enables the slide to be vertically moved with a small change in position and therefore allows a working operation, especially a coining operation, to be carried out with an improved efficiency and with an enhanced safety.

Also, in obtaining a change in slide position curve as shown in FIG. 9 with the modified hydraulic circuit shown in FIG. 5, it is recommended to set the servo valve (SV) 5, the first and second pressurization switching valves (1 PSV) 8 and (2 PVS) 13, the differential switching valve (DSV) 9 and the prefill valve (PFV) 14 in a manner as listed in Table 3 below.

TABLE 3

| SV 5 | Stop Position 5c | | Pressure Descend Position 5a | Pressure Retained Position 5c | Slow Ascend Position 5b | Stop Position 5c | |
|---|---|---|---|---|---|---|---|
| 1 PSV 8 | ON | OFF | ON | ON | ON | ON | OFF |
| 2 PSV 13 | ON | OFF | ON | ON | ON | ON | OFF |
| DSV 9 | OFF | ON | OFF | OFF | OFF | OFF | ON |
| PFV 14 | OFF | ON | OFF | OFF | OFF | OFF | ON |

Figure 10:
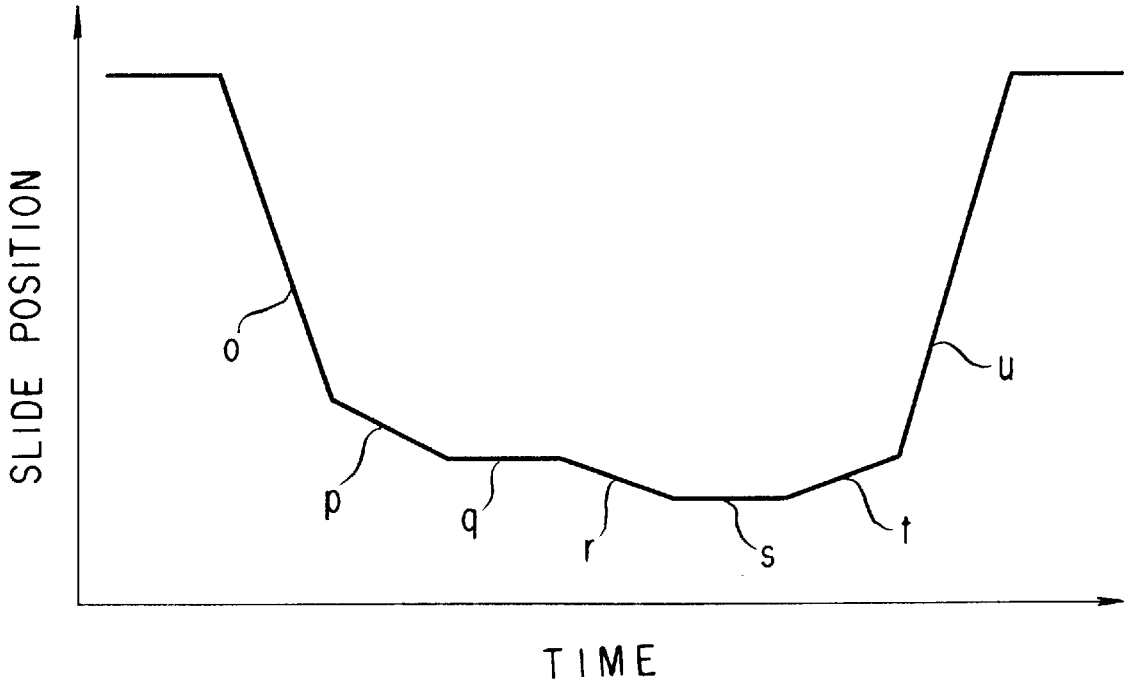
FIG. 10 is a diagram that carries a graph which represents a relationship of the position of a slide with respect to time that can be seen in performing a fourth example of method of controlling a high speed and high load hydraulic drive cylinder system in accordance with the present invention.

On the other hand, it is desired to carry out a multiple step swaging process or a continuous process of swaging followed by blanking or bending followed by blanking a change in slide position curve as shown in FIG. 10 would be required.

In performing a method of controlled operation with the hydraulic circuit shown in FIG. 3 in order to obtain that change in slide position curve, it should be noted that first, starting with the state in which the slide is stopped at its upper dead point, the servo valve 5 will be switched from the neutral position 5*c* to the slide lowering position 5*a*, the pressurization switching valve 8 will be turned OFF, and the differential circuit switching valve 9 will be turned ON.

This will cause pressure fluid discharged from the hydraulic source 4 to be delivered into both the upper and lower chambers 3*c* and 3*d* of the principal cylinder 3 and allow the pressure fluid to flow out of the lower chamber 2*d* of the subsidiary cylinder 2 into the reservoir 11, thus permitting the slide to descend rapidly, as indicated by the line segment o of the curve in FIG. 10, with a difference between the pressure receiving area A1 of the upper chamber 3*c* and the pressure receiving area A2 of the lower chamber 3*d* of the principal cylinder 3.

Thence, when the slide is lowered to a predetermined position requiring a pressing force to be exerted downwards, the pressurization switching valve 8 will be turned ON and the differential circuit switching valve 9 will be turned OFF while maintaining the servo valve 5 at the slide lowering position 5*a*.

This will cause pressure fluid discharged from the hydraulic source 4 to be delivered solely into the upper chamber 3*c* of the principal cylinder 3 and allow pressure fluid to flow out of the lower chamber 2*d* of the subsidiary cylinder 2 and the lower chamber 3*d* of the principal cylinder into the reservoir 11, thus permitting the slide to descend slowly while pressing a workpiece as indicated by the line segment p of the curve in FIG. 10.

Subsequently, should the workpiece be maintained in position with a pressure held exerted thereon, the servo valve 5 will be switched to the neutral position 3*c* while maintaining the pressurization switching valve 8 ON and the differential circuit switching valve 9 OFF. This will cause the slide to be stopped in position to maintain the workpiece in position under the pressure held exerted.

Thereafter, should the slide to be further lowered to carry out, for example, a two step swaging process, the servo valve 5 will be switched to the slide lowering position 5*a* with the pressurization switching valve 8 held ON and the differential circuit switching valve held OFF. This will cause the pressure fluid discharged from the hydraulic source 4 to be delivered solely into the upper chamber 3*c* of the principal cylinder 3 and allow the pressure fluid to flow out of the lower chamber 2*d* of the subsidiary cylinder 2 and the lower chamber 3*d* of the principal cylinder 3 into the reservoir 11, thus permitting the slide to descend again as indicated by the line segment r of the curve in FIG. 10.

Then, if the workpiece is to be held under pressure by the slide having descended down to its lower dead point, the servo valve 5 will be switched to then neutral position 5*c* with the pressurization switching valve 8 held ON and the differential circuit switching valve 9 held OFF. This will cause the slide to be stopped there to hold the workpiece pressed as indicated by the line segment s of the curve in FIG. 10.

Also, should there be a so-called pressure removal to be effected starting from the state in which the workpiece is held pressed, it will be apparent that the servo valve 5 should be switched to the slide raising position 5*b* with the pressurization switching valve 8 held ON and the differential circuit switching valve 9 held OFF.

This will cause the pressure fluid discharged from the hydraulic source 4 to be delivered into both the lower chamber 2*d* of the subsidiary cylinder 2 and the lower chamber 3*d* of the principal cylinder 3 and allow fluid to flow out of the upper chamber 3*c* of the principal cylinder 3 into the reservoir 11, thus permitting the slide to commence ascending slowly as indicated by the line segment t of the curve in FIG. 10 and then the pressing force against the workpiece to be gradually released to accomplish the required pressure removal.

Further, turning the pressurization switching valve 8 OFF and the differential circuit switching valve 9 ON with the servo valve 5 held at the slide raising position 5*b* thereafter will cause the pressure fluid discharged from the hydraulic source to be delivered solely into the lower chamber 2*d* of the subsidiary cylinder 2 and at the same time allow fluid to flow out of the upper chamber 3*c* of the principal cylinder 3 and then to flow via the differential circuit switching valve 9 into the lower chamber 3*d* of the principal chamber 3, thus permitting the slide to ascend rapidly up to the upper dead point as indicated by the line segment u of the curve in FIG. 10.

The method of operation set forth in the preceding paragraphs, because of the ability to consecutively carry out a set of operating steps including: causing a slide to descend, and to be stopped at an optional position followed by exerting a pressure against a workpiece retained in position, thereafter permitting the slide to descend again while pressing the workpiece and thereafter causing the slide to ascend slowly to effect a pressure removal and so forth, allows a multiple step working consecutive operation, or a continued process of swaging or bending followed by blanking to be performed effectively and efficiently and with a reduced number of steps and dies required, as compared with the conventional use of a mechanical press in which those operations had to be carried out separately.

Also, in obtaining a change in slide position curve as shown in FIG. 10 with the modified hydraulic circuit shown in FIG. 5, it is recommended to set the servo valve (SV) 5, the first and second pressurization switching valves (1 PSV) 8 and (2 PVS) 13, the differential switching valve (DSV) 9 and the prefill valve (PFV) 14 in a manner as listed in Table 4 below.

TABLE 4

| SV 5 | Stop Position 5c | | Rapid Descend Position 5a | Pressure Descend Position 5a | Pressure Retained Position 5c | Pressure Descend Position 5a | Pressure Retained Position 5c | Slow Ascend Position 5b | Rapid Ascend Position 5b | Stop Position 5c | |
|---|---|---|---|---|---|---|---|---|---|---|---|
| 1 PSV 8 | ON | OFF | OFF | ON | ON | ON | ON | ON | OFF | ON | OFF |
| 2 PSV 13 | ON | OFF | OFF | ON | ON | ON | ON | ON | OFF | ON | OFF |
| DSV 9 | OFF | ON | ON | OFF | OFF | OFF | OFF | OFF | ON | OFF | ON |
| PFV 14 | OFF | ON | ON | OFF | OFF | OFF | OFF | OFF | ON | OFF | ON |

At this point it should be noted that the present invention for an improved high speed and high load operable hydraulic cylinder system has hereinbefore be described in connection with certain embodiments thereof when used as a slide drive source in a press, this invention and all possible embodiment thereof can naturally be used as a drive source in any of other machine tools and other types of machinery as well.

As set forth hereinbefore specifically and in detail the present invention is directed to an improvement in high speed and high load operable hydraulic drive cylinder system as well as a method of controlling the system. To this end, the invention provides an improved hydraulic cylinder assembly comprising a principal and a subsidiary cylinder with their respective pistons being interconnected by the piston rod of the subsidiary cylinder which is smaller in diameter than the piston rod of the principal cylinder whose upper chamber is different and larger in pressure receiving surface than its lower chamber. There is then made a provision whereby this difference in pressure receiving area allows the cylinder assembly to act rapidly and, when a large load is encountered, a pressure fluid may selectively be delivered into the said upper principal chamber having a larger pressure receiving area to provide a greater output force, thereby meeting with the development of the increased load.

Thus, for example, where the inventive system is applied to a press operation in which a possible bite of one die by another that makes it difficult to detach and remove the pressing die from the receiving workpiece and die is a common problem, a strong raising or lifting force is then found to develop resulting from the summed pressure receiving areas in the subsidiary and principal cylinders, which permits the "bit together" dies to readily depart from each other. Further, it has been found that a noise or vibrations caused due to a breakthrough can markedly be reduced inasmuch as a load of the breakthrough may be received by both of the pressure receiving areas of the principal and subsidiary cylinders.

It has also been noted that the inventive system provides a single rod cylinder/piston configuration which permits the entire cylinder assembly to be considerably short in its length and hence a press in which it is adopted to be significantly reduced in its height and size with a improved rigidity that ensues. Further, with its piston rod reduced in diameter, an improved subsidiary cylinder that is lighter in weight and lower in cost can be provided.

As has also been pointed out, the present invention further involves a method of controlledly operating a high speed and high load hydraulic drive cylinder assembly, which method may comprise: causing the interconnected pistons jointly to descend rapidly followed by descending while exerting a pressure downwards and thereafter permitting the interconnected pistons having so descended jointly to ascend rapidly; causing the interconnected pistons jointly to descend rapidly followed by descending while exerting a pressure downwards, then maintaining the interconnected pistons in a position with a pressure downwards held exerted, and thereafter permitting the said interconnected pistons having so descended jointly to ascend slowly followed by ascending rapidly; and so forth. A variety of selectable patterns of controlled operation can therefor be derived which are represented by corresponding change in slide position curves that are highly suitable for use in a blanking press process and a bending press process as well as for a coining press process.

Because of the ability to form a workpiece in a state devoid of any load of a surge, it has further been found that the inventive method, in sharp contrast with the conventional use of a press for a forming process, allows a die or mold to be prepared with less wear or damage and with a prolonged life of its utility assured. Moreover, as compared with the conventional practice and arrangement in which for a given working process separate steps have been required, the method and system according to the present invention allow the working process to be accomplished with a reduced number of process and forming steps and forming dies required.

Furthermore, varied embodiments of the method set forth provide a variety of patterns for the controlled operation, which are well suited in performing a multiple step consecutive working operation or a consecutive working process of swaging or bending followed by blanking.

These advantages, typified by a reduced number of working steps and working dies required for a given forming process, in turn offer the process an enhanced productivity and a substantial reduction in die cost to an extent which has never been achieved by the simple use of a conventional mechanical press.

While the present invention has hereinbefore been thereof, it will readily be appreciated by a person skilled in the art to be obvious that many alterations thereof, omissions therefrom and additions thereto can be made without departing from the essence and the scope of the present invention. Accordingly, it should be understood that the present invention is not limited to the specific embodiments thereof set out above, but includes all possible embodiments thereof that can be made within the scope with respect to the features specifically set forth in the appended claims and encompasses all the equivalents thereof.

What is claimed is:

1. A high speed and high load operable drive cylinder system which comprises:

a principal hydraulic cylinder receiving a first piston for defining an upper chamber and a lower chamber therein and having a first piston rod extending from said first piston, a subsidiary hydraulic cylinder being smaller in pressure receiving area than said principal cylinder, said subsidiary cylinder receiving a second piston for defining an upper chamber and a lower chamber therein and having a second piston rod extending from said second piston and being smaller in diameter than said first piston rod, said subsidiary cylinder and said principal cylinder being arranged coaxially and disposed vertically up and down, respectively, said first and second pistons being interconnected by said second piston rod; and a fluid delivery means so constructed and associated with said principal and subsidiary cylinders as acting in a first mode of operation to supply pressure fluid selectively into both of the upper and lower chambers of said principal cylinder so as to permit said interconnected pistons jointly to descend rapidly with a difference in pressure receiving area between said upper and lower chambers of the principal cylinder, said fluid delivery means also acting in a second mode of operation to supply pressure fluid selectively into only the upper chamber of said principal cylinder so as to cause said interconnected pistons jointly to descend while exerting a pressure downwards, acting in a third mode of operation to terminate a supply of pressure fluid into the upper and lower chambers of said principal cylinder and the lower chamber of said subsidiary cylinder so as to maintain said interconnected pistons substantially in a position with a pressure downwards held exerted and acting in a fourth mode of operation to supply pressure fluid selectively into both of the lower chamber of said subsidiary cylinder and the lower chamber of said principal cylinder so as to permit said interconnected pistons jointly to ascend slowly, said fluid delivery means further acting in a fifth mode of operation to supply pressure fluid selectively into only the lower chamber of said subsidiary cylinder so as to permit said interconnected pistons jointly to ascend rapidly.

2. A high speed and high load operable drive cylinder system which comprises:

a principal hydraulic cylinder receiving a first piston for defining an upper chamber and a lower chamber therein and having a first piston rod extending from said first piston, a subsidiary hydraulic cylinder being smaller in pressure receiving area than said principal cylinder, said subsidiary cylinder receiving a second piston for defining an upper chamber and a lower chamber therein and having a second piston rod extending from said second piston and being smaller in diameter than said first piston rod, said subsidiary cylinder and said principal cylinder being arranged coaxially and disposed vertically up and down, respectively, said first and second pistons being interconnected by said second piston rod; and a fluid delivery means so constructed and associated with said principal and subsidiary cylinders as acting in a first mode of operation to supply pressure fluid selectively into both of the upper and lower chambers of said principal cylinder so as to permit said interconnected pistons jointly to descend rapidly with a difference in pressure receiving area between said upper and lower chambers of the principal cylinder, said fluid delivery means also acting in a second mode of operation to supply pressure fluid selectively into both of the upper chamber of said subsidiary cylinder and the upper chamber of said principal cylinder so as to cause said interconnected pistons jointly to descend while exerting a pressure downwards, acting in a third mode of operation to terminate a supply of pressure fluid into the upper and lower chambers of said principal cylinder and the upper and lower chamber of said subsidiary cylinder so as to maintain said interconnected pistons substantially in a position with a pressure downwards held exerted and acting in a fourth mode of operation to supply pressure fluid selectively into both the lower chamber of said subsidiary cylinder and the lower chamber of said principal cylinder so as to permit said interconnected pistons jointly to ascend slowly, said fluid delivery means further acting in a fifth mode of operation to supply pressure fluid selectively into only the lower chamber of said subsidiary cylinder so as to permit said interconnected pistons jointly to ascend rapidly.

3. A high speed and high load operable drive cylinder system as set forth in claim 1, in which said fluid delivery means includes a first pipe conduit connected to the lower chamber of said subsidiary cylinder; a second pipe conduit connected to the upper chamber of said principal cylinder; a servo valve for switching over and thereby selectively establishing and blocking one and the other of fluid communications between said first and second pipe conduits on the one hand and a source of the pressure fluid and a reservoir on the other hand; a first pressurization switching valve for establishing and blocking a fluid communication between said first pipe conduit and the lower chamber of said principal cylinder; a differential circuit switching valve for establishing and blocking a fluid communication between said second pipe conduit and the lower chamber of said principal cylinder; and a breather for connecting the upper chamber of said subsidiary cylinder in a fluid communication with the atmosphere.

4. A high speed and high load operable drive cylinder system as set forth in claim 1, in which said fluid delivery means includes a first pipe conduit connected to the lower chamber of said subsidiary cylinder; a second pipe conduit connected to the upper chamber of said principal cylinder; a servo valve for switching over and thereby selectively establishing and blocking one and the other of fluid communications between said first and second pipe conduits on the one hand and a source of the pressure fluid and a reservoir on the other hand; a first pressurization switching valve for establishing and blocking a fluid communication between said first pipe conduit and the lower chamber of said principal cylinder; a differential circuit switching valve for establishing and blocking a fluid communication between said second pipe conduit and the lower chamber of said principal cylinder; a second pressurization switching valve for establishing and blocking a fluid communication between said second pipe conduit and the upper chamber of said subsidiary cylinder; a prefill valve for establishing and blocking a fluid communication between said subsidiary cylinder and said reservoir.

5. A method of controlling a high speed and high load operable drive cylinder system which comprises: a principal hydraulic cylinder receiving a first piston for defining an upper chamber and a lower chamber therein and having a first piston rod extending from said first piston, a subsidiary hydraulic cylinder being smaller in pressure receiving area than said principal cylinder, said subsidiary cylinder receiving a second piston for defining an upper chamber and a lower chamber therein and having a second piston rod extending from said second piston and being smaller in diameter than said first piston rod, said subsidiary cylinder and said principal cylinder being arranged coaxially and disposed vertically up and down, respectively, said first and second pistons being interconnected by said second piston rod; and a fluid delivery means so constructed and associated with said principal and subsidiary cylinders as acting in a first mode of operation to supply pressure fluid selectively into both of the upper and lower chambers of said principal cylinder so as to permit said interconnected pistons jointly to descend rapidly with a difference in pressure receiving area between said upper and lower chambers of the principal cylinder, said fluid delivery means also acting in a second mode of operation to supply pressure fluid selectively into only the upper chamber of said principal cylinder so as to cause said interconnected pistons jointly to descend while exerting a pressure downwards, acting in a third mode of operation to terminate a supply of pressure fluid into the upper and lower chambers of said principal cylinder and the lower chamber of said subsidiary cylinder so as to maintain said interconnected pistons substantially in a position with a pressure downwards held exerted and acting in a fourth mode of operation to supply pressure fluid selectively into both of the lower chamber of said subsidiary cylinder and the lower chamber of said principal cylinder so as to permit said interconnected pistons jointly to ascend slowly, said fluid delivery means further acting in a fifth mode of operation to supply pressure fluid selectively into only the lower chamber of said subsidiary cylinder so as to permit said interconnected pistons jointly to ascend rapidly, said method comprising the steps of:

causing said interconnected pistons jointly to descend rapidly followed by descending while exerting a pressure downwards; and thereafter permitting said interconnected pistons to ascend rapidly.

6. A method of controlling a high speed and high load operable drive cylinder system which comprises: a principal hydraulic cylinder receiving a first piston for defining an upper chamber and a lower chamber therein and having a first piston rod extending from said first piston, a subsidiary hydraulic cylinder being smaller in pressure receiving area than said principal cylinder, said subsidiary cylinder receiving a second piston for defining an upper chamber and a lower chamber therein and having a second piston rod extending from said second piston and being smaller in diameter than said first piston rod, said subsidiary cylinder and said principal cylinder being arranged coaxially and disposed vertically up and down, respectively, said first and second pistons being interconnected by said second piston rod; and a fluid delivery means so constructed and associated with said principal and subsidiary cylinders as acting in a first mode of operation to supply pressure fluid selectively into both of the upper and lower chambers of said principal cylinder so as to permit said interconnected pistons jointly to descend rapidly with a difference in pressure receiving area between said upper and lower chambers of the principal cylinder, said fluid delivery means also acting in a second mode of operation to supply pressure fluid selectively into only the upper chamber of said principal cylinder so as to cause said interconnected pistons jointly to descend while exerting a pressure downwards, acting in a third mode of operation to terminate a supply of pressure fluid into the upper and lower chambers of said principal cylinder and the lower chamber of said subsidiary cylinder so as to maintain said interconnected pistons substantially in a position with a pressure downwards held exerted and acting in a fourth mode of operation to supply pressure fluid selectively into both of the lower chamber of said subsidiary cylinder and the lower chamber of said principal cylinder so as to permit said interconnected pistons jointly to ascend slowly, said fluid delivery means further acting in a fifth mode of operation to supply pressure fluid selectively into only the lower chamber of said subsidiary cylinder so as to permit said interconnected pistons jointly to ascend rapidly, said method comprising the steps of:

causing said interconnected pistons jointly to descend rapidly followed by descending while exerting a pressure downwards;

thereafter maintaining said interconnected pistons substantially in a position with a pressure downwards held exerted, and thereafter permitting said interconnected pistons to ascend slowly followed by ascending rapidly.

7. A method of controlling a high speed and high load operable drive cylinder system which comprises: a principal hydraulic cylinder receiving a first piston for defining an upper chamber and a lower chamber therein and having a first piston rod extending from said first piston, a subsidiary hydraulic cylinder being smaller in pressure receiving area than said principal cylinder, said subsidiary cylinder receiving a second piston for defining an upper chamber and a lower chamber therein and having a second piston rod extending from said second piston and being smaller in diameter than said first piston rod, said subsidiary cylinder and said principal cylinder being arranged coaxially and disposed vertically up and down, respectively, said first and second pistons being interconnected by said second piston rod; and a fluid delivery means so constructed and associated with said principal and subsidiary cylinders as acting in a first mode of operation to supply pressure fluid selectively into both of the upper and lower chambers of said principal cylinder so as to permit said interconnected pistons jointly to descend rapidly with a difference in pressure receiving area between said upper and lower chambers of the principal cylinder, said fluid delivery means also acting in a second mode of operation to supply pressure fluid selectively into only the upper chamber of said principal cylinder so as to cause said interconnected pistons jointly to descend while exerting a pressure downwards, acting in a third mode of operation to terminate a supply of pressure fluid into the upper and lower chambers of said principal cylinder and the lower chamber of said subsidiary cylinder so as to maintain said interconnected pistons substantially in a position with a pressure downwards held exerted and acting in a fourth mode of operation to supply pressure fluid selectively into both of the lower chamber of said subsidiary cylinder and the lower chamber of said principal cylinder so as to permit said interconnected pistons jointly to ascend slowly, said fluid delivery means further acting in a fifth mode of operation to supply pressure fluid selectively into only the lower chamber of said subsidiary cylinder so as to permit said interconnected pistons jointly to ascend rapidly, said method comprising the steps of:

causing said interconnected pistons jointly to descend while exerting a pressure downwards;

thereafter maintaining said interconnected pistons substantially in a position with a pressure downwards held exerted; and thereafter permitting said interconnected pistons jointly to ascend slowly.

8. A method of controlling a high speed and high load operable drive cylinder system which comprises: a principal hydraulic cylinder receiving a first piston for defining an upper chamber and a lower chamber therein and having a first piston rod extending from said first piston, a subsidiary hydraulic cylinder being smaller in pressure receiving area than said principal cylinder, said subsidiary cylinder receiving a second piston for defining an upper chamber and a lower chamber therein and having a second piston rod extending from said second piston and being smaller in diameter than said first piston rod, said subsidiary cylinder and said principal cylinder being arranged coaxially and disposed vertically up and down, respectively, said first and second pistons being interconnected by said second piston rod; and a fluid delivery means so constructed and associated with said principal and subsidiary cylinders as acting in a first mode of operation to supply pressure fluid selectively into both of the upper and lower chambers of said principal cylinder so as to permit said interconnected pistons jointly to descend rapidly with a difference in pressure receiving area between said upper and lower chambers of the principal cylinder, said fluid delivery means also acting in a second mode of operation to supply pressure fluid selectively into only the upper chamber of said principal cylinder so as to cause said interconnected pistons jointly to descend while exerting a pressure downwards, acting in a third mode of operation to terminate a supply of pressure fluid into the upper and lower chambers of said principal cylinder and the lower chamber of said subsidiary cylinder so as to maintain said interconnected pistons substantially in a position with a pressure downwards held exerted and acting in a fourth mode of operation to supply pressure fluid selectively into both of the lower chamber of said subsidiary cylinder and the lower chamber of said principal cylinder so as to permit said interconnected pistons jointly to ascend slowly, said fluid delivery means further acting in a fifth mode of operation to supply pressure fluid selectively into only the lower chamber of said subsidiary cylinder so as to permit said interconnected pistons jointly to ascend rapidly, said method comprising the steps of:

causing said interconnected pistons jointly to descend rapidly followed by descending while exerting a pressure downwards;

thereafter maintaining said interconnected pistons substantially in a position with a pressure downwards held exerted;

thereafter causing said interconnected pistons jointly to descend while exerting a pressure downwards;

thereafter maintaining said interconnected pistons substantially in a position with a pressure downwards held exerted; and thereafter permitting said interconnected pistons jointly to ascend slowly followed by ascending rapidly.

9. A method of controlling a high speed and high load operable drive cylinder system which comprises: a principal hydraulic cylinder receiving a first piston for defining an upper chamber and a lower chamber therein and having a first piston rod extending from said first piston, a subsidiary hydraulic cylinder being smaller in pressure receiving area than said principal cylinder, said subsidiary cylinder receiving a second piston for defining an upper chamber and a lower chamber therein and having a second piston rod extending from said second piston and being smaller in diameter than said first piston rod, said subsidiary cylinder and said principal cylinder being arranged coaxially and disposed vertically up and down, respectively, said first and second pistons being interconnected by said second piston rod; and a fluid delivery means so constructed and associated with said principal and subsidiary cylinders as acting in a first mode of operation to supply pressure fluid selectively into both of the upper and lower chambers of said principal cylinder so as to permit said interconnected pistons jointly to descend rapidly with a difference in pressure receiving area between said upper and lower chambers of the principal cylinder, said fluid delivery means also acting in a second mode of operation to supply pressure fluid selectively into both of the upper chamber of said subsidiary cylinder and the upper chamber of said principal cylinder so as to cause said interconnected pistons jointly to descend while exerting a pressure downwards, acting in a third mode of operation to terminate a supply of pressure fluid into the upper and lower chambers of said principal cylinder and the upper and lower chamber of said subsidiary cylinder so as to maintain said interconnected pistons substantially in a position with a pressure downwards held exerted and acting in a fourth mode of operation to supply pressure fluid selectively into both the lower chamber of said subsidiary cylinder and the lower chamber of said principal cylinder so as to permit said interconnected pistons jointly to ascend slowly, said fluid delivery means further acting in a fifth mode of operation to supply pressure fluid selectively into only the lower chamber of said subsidiary cylinder so as to permit said interconnected pistons jointly to ascend rapidly, said method comprising the steps of:

causing said interconnected pistons jointly to descend rapidly followed by descending while exerting a pressure downwards; and thereafter permitting said interconnected pistons to ascend rapidly.

10. A method of controlling a high speed and high load operable drive cylinder system which comprises: a principal hydraulic cylinder receiving a first piston for defining an upper chamber and a lower chamber therein and having a first piston rod extending from said first piston, a subsidiary hydraulic cylinder being smaller in pressure receiving area than said principal cylinder, said subsidiary cylinder receiving a second piston for defining an upper chamber and a lower chamber therein and having a second piston rod extending from said second piston and being smaller in diameter than said first piston rod, said subsidiary cylinder and said principal cylinder being arranged coaxially and disposed vertically up and down, respectively, said first and second pistons being interconnected by said second piston rod; and a fluid delivery means so constructed and associated with said principal and subsidiary cylinders as acting in a first mode of operation to supply pressure fluid selectively into both of the upper and lower chambers of said principal cylinder so as to permit said interconnected pistons jointly to descend rapidly with a difference in pressure receiving area between said upper and lower chambers of the principal cylinder, said fluid delivery means also acting in a second mode of operation to supply pressure fluid selectively into both of the upper chamber of said subsidiary cylinder and the upper chamber of said principal cylinder so as to cause said interconnected pistons jointly to descend while exerting a pressure downwards, acting in a third mode of operation to terminate a supply of pressure fluid into the upper and lower chambers of said principal cylinder and the upper and lower chamber of said subsidiary cylinder so as to maintain said interconnected pistons substantially in a position with a pressure downwards held exerted and acting in a fourth mode of operation to supply pressure fluid selectively into both the lower chamber of said subsidiary cylinder and the lower chamber of said principal cylinder so as to permit said interconnected pistons jointly to ascend slowly, said fluid delivery means further acting in a fifth mode of operation to supply pressure fluid selectively into only the lower chamber of said subsidiary cylinder so as to permit said interconnected pistons jointly to ascend rapidly, said method comprising the steps of:

causing said interconnected pistons jointly to descend rapidly followed by descending while exerting a pressure downwards;

thereafter maintaining said interconnected pistons substantially in a position with a pressure downwards held exerted, and thereafter permitting said interconnected pistons to ascend slowly followed by ascending rapidly.

11. A method of controlling a high speed and high load operable drive cylinder system which comprises: a principal hydraulic cylinder receiving a first piston for defining an upper chamber and a lower chamber therein and having a first piston rod extending from said first piston, a subsidiary hydraulic cylinder being smaller in pressure receiving area than said principal cylinder, said subsidiary cylinder receiving a second piston for defining an upper chamber and a lower chamber therein and having a second piston rod extending from said second piston and being smaller in diameter than said first piston rod, said subsidiary cylinder and said principal cylinder being arranged coaxially and disposed vertically up and down, respectively, said first and second pistons being interconnected by said second piston rod; and a fluid delivery means so constructed and associated with said principal and subsidiary cylinders as acting in a first mode of operation to supply pressure fluid selectively into both of the upper and lower chambers of said principal cylinder so as to permit said interconnected pistons jointly to descend rapidly with a difference in pressure receiving area between said upper and lower chambers of the principal cylinder, said fluid delivery means also acting in a second mode of operation to supply pressure fluid selectively into both of the upper chamber of said subsidiary cylinder and the upper chamber of said principal cylinder so as to cause said interconnected pistons jointly to descend while exerting a pressure downwards, acting in a third mode of operation to terminate a supply of pressure fluid into the upper and lower chambers of said principal cylinder and the upper and lower chamber of said subsidiary cylinder so as to maintain said interconnected pistons substantially in a position with a pressure downwards held exerted and acting in a fourth mode of operation to supply pressure fluid selectively into both the lower chamber of said subsidiary cylinder and the lower chamber of said principal cylinder so as to permit said interconnected pistons jointly to ascend slowly, said fluid delivery means further acting in a fifth mode of operation to supply pressure fluid selectively into only the lower chamber of said subsidiary cylinder so as to permit said interconnected pistons jointly to ascend rapidly, said method comprising the steps of:

causing said interconnected pistons jointly to descend while exerting a pressure downwards;

thereafter maintaining said interconnected pistons substantially in a position with a pressure downwards held exerted; and thereafter permitting said interconnected pistons jointly to ascend slowly.

12. A method of controlling a high speed and high load operable drive cylinder system which comprises: a principal hydraulic cylinder receiving a first piston for defining an upper chamber and a lower chamber therein and having a first piston rod extending from said first piston, a subsidiary hydraulic cylinder being smaller in pressure receiving area than said principal cylinder, said subsidiary cylinder receiving a second piston for defining an upper chamber and a lower chamber therein and having a second piston rod extending from said second piston and being smaller in diameter than said first piston rod, said subsidiary cylinder and said principal cylinder being arranged coaxially and disposed vertically up and down, respectively, said first and second pistons being interconnected by said second piston rod; and a fluid delivery means so constructed and associated with said principal and subsidiary cylinders as acting in a first mode of operation to supply pressure fluid selectively into both of the upper and lower chambers of said principal cylinder so as to permit said interconnected pistons jointly to descend rapidly with a difference in pressure receiving area between said upper and lower chambers of the principal cylinder, said fluid delivery means also acting in a second mode of operation to supply pressure fluid selectively into both of the upper chamber of said subsidiary cylinder and the upper chamber of said principal cylinder so as to cause said interconnected pistons jointly to descend while exerting a pressure downwards, acting in a third mode of operation to terminate a supply of pressure fluid into the upper and lower chambers of said principal cylinder and the upper and lower chamber of said subsidiary cylinder so as to maintain said interconnected pistons substantially in a position with a pressure downwards held exerted and acting in a fourth mode of operation to supply pressure fluid selectively into both the lower chamber of said subsidiary cylinder and the lower chamber of said principal cylinder so as to permit said interconnected pistons jointly to ascend slowly, said fluid delivery means further acting in a fifth mode of operation to supply pressure fluid selectively into only the lower chamber of said subsidiary cylinder so as to permit said interconnected pistons jointly to ascend rapidly, said method comprising the steps of:

causing said interconnected pistons jointly to descend rapidly followed by descending while exerting a pressure downwards;

thereafter maintaining said interconnected pistons substantially in a position with a pressure downwards held exerted;

thereafter causing said interconnected pistons jointly to descend while exerting a pressure downwards;

thereafter maintaining said interconnected pistons substantially in a position with a pressure downwards held exerted; and thereafter permitting said interconnected pistons jointly ascend slowly followed by ascending rapidly.

13. A high speed and high load operable drive cylinder system as set forth in claim 2, in which said fluid delivery means includes a first pipe conduit connected to the lower chamber of said subsidiary cylinder; a second pipe conduit connected to the upper chamber of said principal cylinder; a servo valve for switching over and thereby selectively establishing and blocking one and the other of fluid communications between said first and second pipe conduits on the one hand and a source of the pressure fluid and a reservoir on the other hand; a first pressurization switching valve for establishing and blocking a fluid communication between said first pipe conduit and the lower chamber of said principal cylinder; a differential circuit switching valve for establishing and blocking a fluid communication between said second pipe conduit and the lower chamber of said principal cylinder; and a breather for connecting the upper chamber of said subsidiary cylinder in a fluid communication with the atmosphere.

14. A high speed and high load operable drive cylinder system as set forth in claim 2, in which said fluid delivery means includes a first pipe conduit connected to the lower chamber of said subsidiary cylinder; a second pipe conduit connected to the upper chamber of said principal cylinder; a servo valve for switching over and thereby selectively establishing and blocking one and the other of fluid communications between said first and second pipe conduits on the one hand and a source of the pressure fluid and a reservoir on the other hand; a first pressurization switching valve for establishing and blocking a fluid communication between said first pipe conduit and the lower chamber of said principal cylinder; a differential circuit switching valve for establishing and blocking a fluid communication between said second pipe conduit and the lower chamber of said principal cylinder; a second pressurization switching valve for establishing and blocking a fluid communication between said second pipe conduit and the upper chamber of said subsidiary cylinder; a prefill valve for establishing and blocking a fluid communication between said subsidiary cylinder and said reservoir.

* * * * *